United States Patent [19]

Takahashi et al.

[11] Patent Number: 4,776,713

[45] Date of Patent: Oct. 11, 1988

[54] HOME POSITION DETECTING APPARATUS FOR A PRINT WHEEL

[75] Inventors: Makoto Takahashi, Shizuoka; Akira Nuita, Mishima, both of Japan

[73] Assignee: Tokyo Electric Co., Ltd., Tokyo, Japan

[21] Appl. No.: 820,564

[22] Filed: Jan. 21, 1986

[30] Foreign Application Priority Data

Feb. 1, 1985 [JP] Japan ..... 60-18113

[51] Int. Cl.[4] ..... B41J 1/30

[52] U.S. Cl. ..... 400/144.2; 400/163

[58] Field of Search ..... 400/144.2, 144.3, 322, 400/902, 903, 163; 318/640, 685, 696

[56] References Cited

U.S. PATENT DOCUMENTS

| | | | |
|---|---|---|---|
| 3,574,326 | 4/1971 | Koehn . | |
| 4,118,129 | 10/1978 | Grudherr | 400/144.2 |
| 4,129,813 | 12/1978 | Hunts et al. | 318/685 |
| 4,214,837 | 7/1980 | Bacher | 400/144.2 |
| 4,226,546 | 10/1980 | Hoffman | 400/144.2 |
| 4,315,198 | 2/1982 | Lin et al. | 400/144.2 |
| 4,398,837 | 8/1983 | Torii et al. . | |
| 4,622,505 | 11/1986 | Okabayashi et al. | 318/685 |

FOREIGN PATENT DOCUMENTS

| | | | |
|---|---|---|---|
| 1280 | 1/1984 | Japan | 400/144.2 |
| 1604577 | 12/1981 | United Kingdom | 400/144.2 |

OTHER PUBLICATIONS

J. A. Barnett et al., "Stepping-Motor Step Control"; *IBM Tech. Disc. Bull.;* vol. 19, No. 8, pp. 2974–2975; Jan. 1977.

*Primary Examiner*—David A. Wiecking

*Attorney, Agent, or Firm*—Frishauf, Holtz, Goodman & Woodward

[57] ABSTRACT

A home position detecting apparatus includes a detector to generate a detection signal when the home position of a print wheel is detected and a stepping motor to rotate the print wheel in response to a drive signal. This home position detecting apparatus further includes a control circuit which gives the drive signal having a specific phase to the stepping motor in response to the detection signal from the detector.

5 Claims, 6 Drawing Sheets

HOME POSITION DETECTING APPARATUS FOR A PRINT WHEEL

BACKGROUND OF THE INVENTION

The present invention relates to a home position detecting apparatus for use in a printing apparatus having a print wheel.

Hitherto, there are known home position detecting apparatuses in which, for example, as shown in FIG. 1, a light emitting element 1 and a photoelectric element 2 are arranged to face each other through a print wheel PW at a position where a detecting hole DH formed at the home position of the print wheel passes so that the home position of this print wheel can be detected. In this case, the use of the structure of light emitting element 1 and photoelectric element 2 which are integrally formed can present a high detection accuracy since the perfect positional relationship is obtained between those elements. However, it is difficult to form such an integral structure of light emitting element 1 and photoelectric element 2 due to the mechanical limitation with the print wheel interposed therebetween. Therefore, light emitting element 1 and photoelectric element 2 are separately assembled and the relative positional relationship therebetween is adjusted.

However, such a separate assembly of light emitting element 1 and photoelectric element 2 has the following problem due to variations in sensitivities of those elements and due to the positional relationship therebetween. Namely, the output characteristic of the detecting apparatus may vary within a range determined by broken lines A and B in FIG. 2. Thus, if a detection level DL is set in accordance with an output characteristic B and then the detecting apparatus having an output characteristic A is used, there is a possibility that not only a normal home position HP but also adjacent step positions (HP+1) and (HP−1) are detected. Consequently, the step position adjacent to the normal home position is regarded as the home position. In FIG. 2, a solid line C represents the output characteristic of the detecting apparatus in the case where the sensitivities of light emitting element 1 and photoelectric element 2 are normal and also the positional relationship therebetween is normal.

SUMMARY OF THE INVENTION

It is an object of the present invention to provide a home position detecting apparatus which can always certainly detect the home position of the print wheel of the printing apparatus.

This object is accomplished by a home position detetting apparatus comprising a detector to generate a detection signal when the home position of a print wheel is detected, a stepping motor to rotate this print wheel in response to a drive signal, and a control circuit to give the drive signal having a special phase to the stepping motor in response to a detection signal from the detector.

According to this invention, the drive signal of the specified phase is given to the stepping motor even in the case where the detection signal is generated from the detector when the print wheel is held at the position which is shifted by one step from the normal home position, so that the print wheel is driven by one step and set at the normal home position. Due to this, the detection signal from the detector indicates that the print wheel is set at the home position.

DETAILED DESCRIPTION OF THE PREFERRED EMBODIMENT

An explanation will then be made hereinbelow with respect to the case where a home position detecting apparatus according to an embodiment of the present invention is applied to an electronic typewriter.

Figure 1:
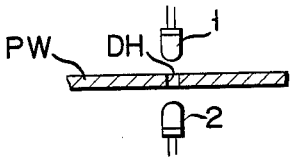
FIG. 1 (PRIOR ART)
FIG. 1 shows the positional relationships between light emitting and photoelectric elements of a home position detector which is ordinarily used and a detecting hole formed at the home position of a print wheel.
Figure 2:
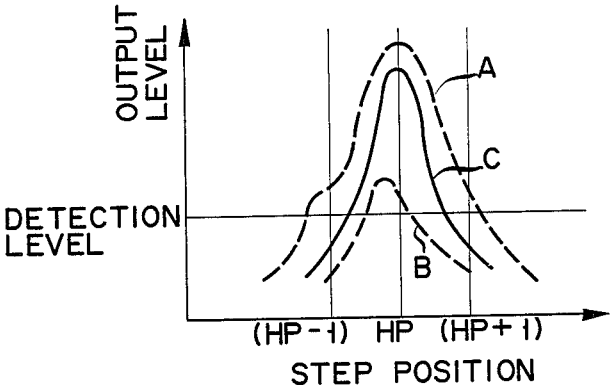
FIG. 2 (PRIOR ART)
FIG. 2 shows an output characteristic diagram of the home position detector shown in FIG. 1.
Figure 3:
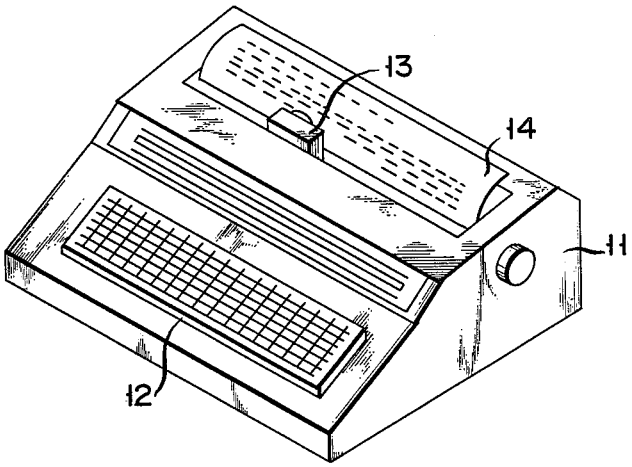
FIG. 3 is a perspective view of an electronic typewriter including therein a home position detecting apparatus according to an embodiment of the invention.
Figure 4:
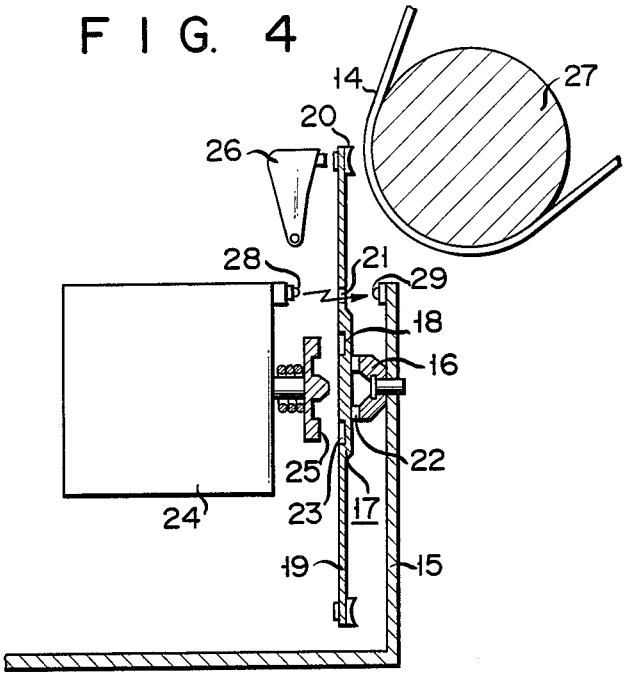
FIG. 4 is a constructional diagram of the main part of the electronic typewriter shown in FIG. 3 including the home position detecting apparatus according to the embodiment of the invention.
Figure 5:
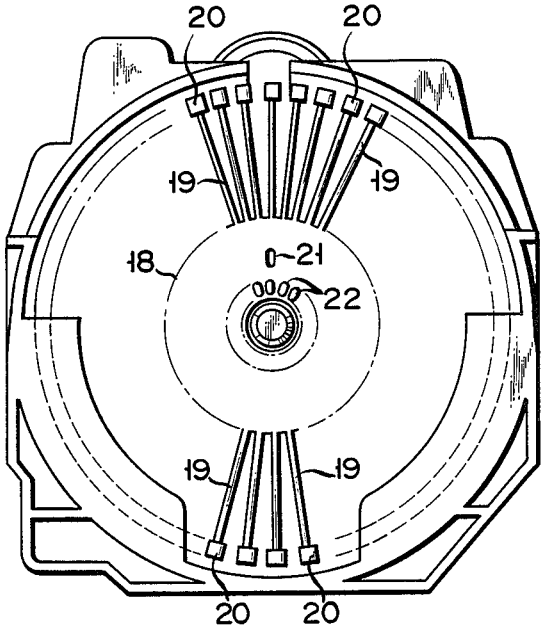
FIG. 5 illustrates a print wheel enclosed in a casing.

FIG. 3 shows an electronic typewriter comprising a housing 11, a keyboard 12 having keys for inputting characters, numerals, symbols, etc. and function keys such as a repeat key and the like, and a printing apparatus 13 for printing data on a paper 14. As shown in FIG. 4, printing apparatus 13 is constituted such that a rotor 16 is rotatably attached to a frame 15 and a print wheel 17 is fixed to rotor 16. As shown in FIG. 5, print wheel 17 is constituted such that a plurality of spokes 19 are formed around a rotary base 18 and a type font 20 is attached at an end of each spoke 19. A home position is set to rotary base 18 and a detecting hole 21 is formed at the position corresponding to the home position. Projections 22 adapted to be come into engagement with the end portion of rotor 16 are formed on rotary base 18 at positions inside of detecting hole 21 of rotary base 18. Concave portions 23 are formed in the surface of rotary base 18 of print wheel 17 on the side opposite to the surface on which rotation stopping projections 22 are formed. Convex portions of coupling member 25 attached to the end portion of the rotary axis of wheel motor 24 formed of a stepping motor are brought into engagement with concave portions 23. A hammer 26 is arranged to face the back side of type font 20 attached to the end of the spoke of print wheel 17. A platen 27 around which paper 14 is set is arranged in front of type font 20 of print wheel 17. A light emitting element 28 and a photoelectric element 29 are arranged to face each other through print wheel 17 at the position where detecting hole 21 of print wheel 17 passes. Namely, light emitting element 28 is attached to a casing of wheel motor 24 and photoelectric element 29 is attached to frame 15, thereby allowing detecting hole 21 of print wheel 17 to be detected.

Figure 6:
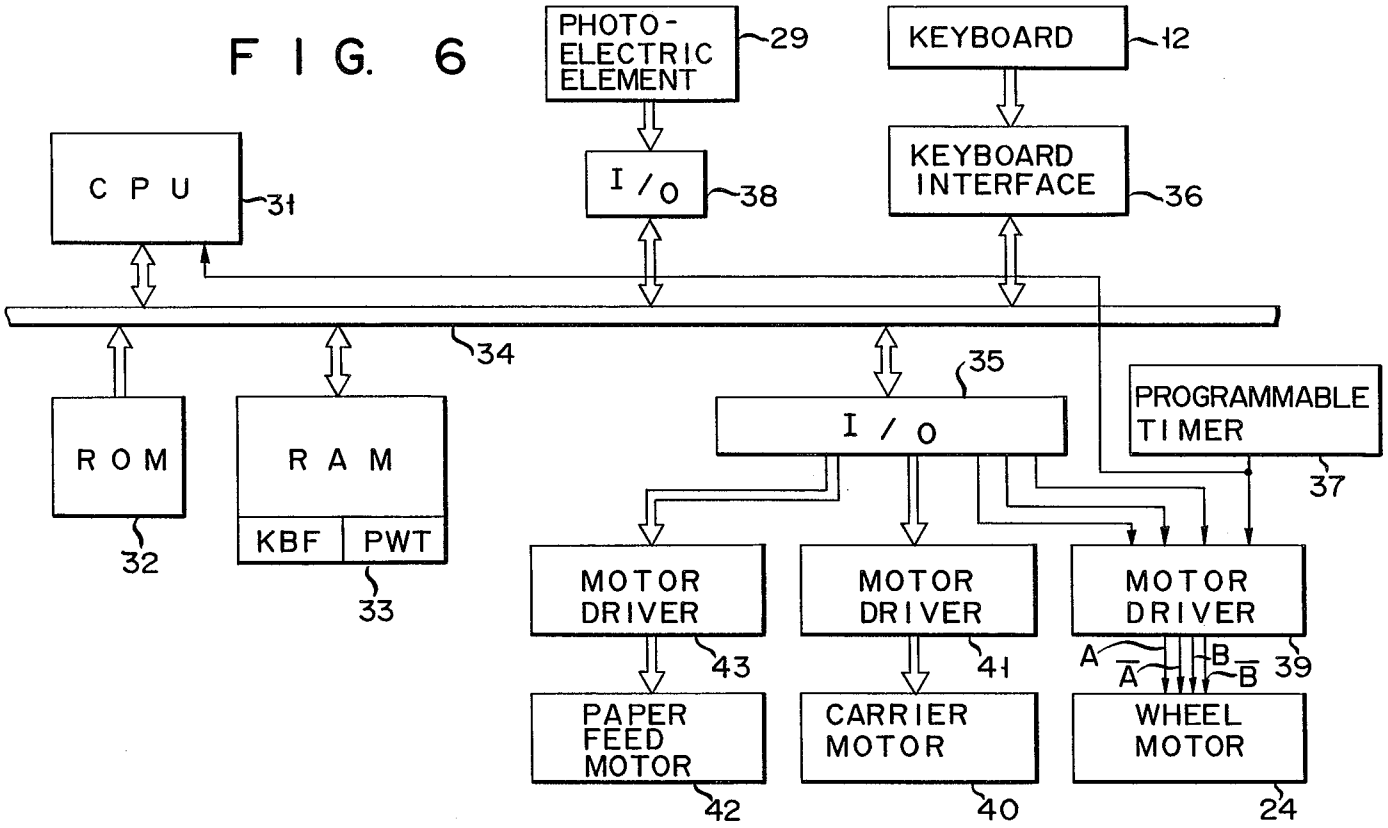
FIG. 6 is a block diagram of a control circuit of the electronic typewriter shown in FIG. 3.

FIG. 6 is a block diagram showing a circuit construction of the electronic typewriter shown in FIG. 3. This electronic typewriter includes a central processing unit (CPU) 31, a read only memory (ROM) 32 in which program data is stored, and a random access memory (RAM) 33 having a key buffer KBF and a wheel return timer PWT and the like. Wheel return timer PWT starts measuring a predetermined time when type font 20 is hit by hammer 26. CPU 31, ROM 32, and RAM 33 are connected by a bus line 34. CPU 31 is connected to I/O ports 35 and 38 and a keyboard interface 36 through bus line 34. CPU 31 is also connected to a programmable timer 37. Keyboard 12 is connected to keyboard interface 36. Photoelectric element 29 is connected to I/O port 38. When wheel motor 24 rotates, programmable timer 37 generates a clock signal CLK to determine a timing to switch the exciting phase of wheel motor 24. Signal CLK is supplied to a motor driver 39 to rotate wheel motor 24 and is also supplied to CPU 31. CPU 31 supplies a direction signal DIR to determine the rotating direction of print wheel 17, a rotation instruction signal ENA to instruct the rotation of print wheel 17, and a clear signal CLR to set the exciting phase of wheel motor 24 at the home position into a predetermined exciting phase to wheel motor driver 39 through I/O port 35, respectively. Through I/O port 35, CPU 31 controls a motor driver 41 of a carrier motor 40 to move a carrier (not shown) on which print wheel 17 is mounted and also controls a motor driver 43 of a paper feed motor 42 to feed paper 14.

Figure 7:
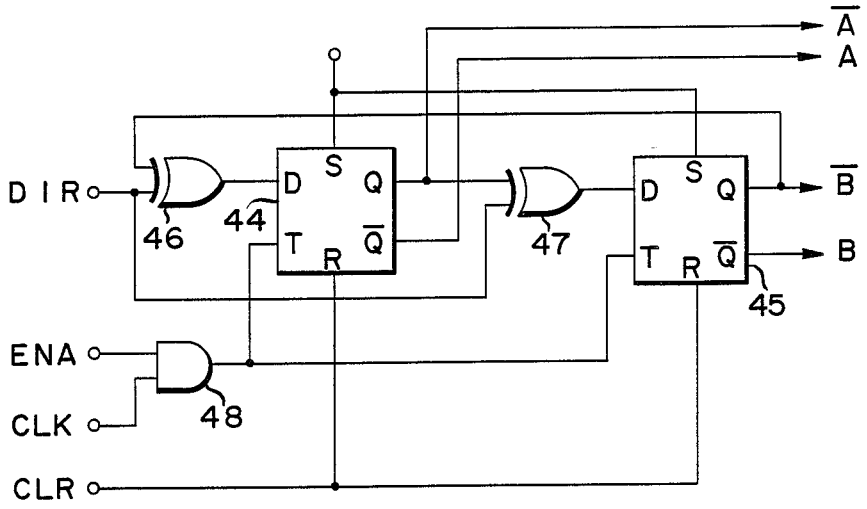
FIG. 7 is a circuit diagram of a wheel motor driver shown in FIG. 6.

A control circuit shown in FIG. 7 is built in motor driver 39. This control circuit includes two flip-flop circuits 44 and 45, two exclusive OR circuits 46 and 47, and an AND circuit 48. Direction signal DIR is inputted to one input terminal of each of exclusive OR circuits 46 and 47. An output terminal of exclusive OR circuit 46 is connected to an input terminal D of flip-flop circuit 44. Rotation instruction signal ENA and clock signal CLK are inputted to first and second input terminals of AND circuit 48. An output terminal of AND circuit 48 is connected to input terminals T of flip-flop circuits 44 and 45. A positive voltage +V is applied to set terminals S ot flip-flop circuits 44 and 45, and clear signal CLR is inputted to those reset terminals R.

An output signal from an output terminal Q of flip-flop circuit 44 is outputted as an excitation signal $\overline{A}$ and is also inputted to the other input terminal of exclusive OR circuit 47. An output signal from an output terminal $\overline{Q}$ of flip-flop circuit 44 is outputted as an excitation signal A. An output terminal of exclusive OR circuit 47 is connected to an input terminal D of flip-flop circuit 45. An output signal from an output terminal Q of flip-flop circuit 45 is inputted to the other input terminal of exclusive OR circuit 46 and is also outputted as an excitation signal $\overline{B}$. An output signal from an output terminal $\overline{Q}$ of flip-flop circuit 45 is outputted as an excitation signal B. Excitation signals A, $\overline{A}$, B, and $\overline{B}$ are supplied to wheel motor 24, so that the operation exciting phase of wheel motor 24 can be determined.

Figure 8A:
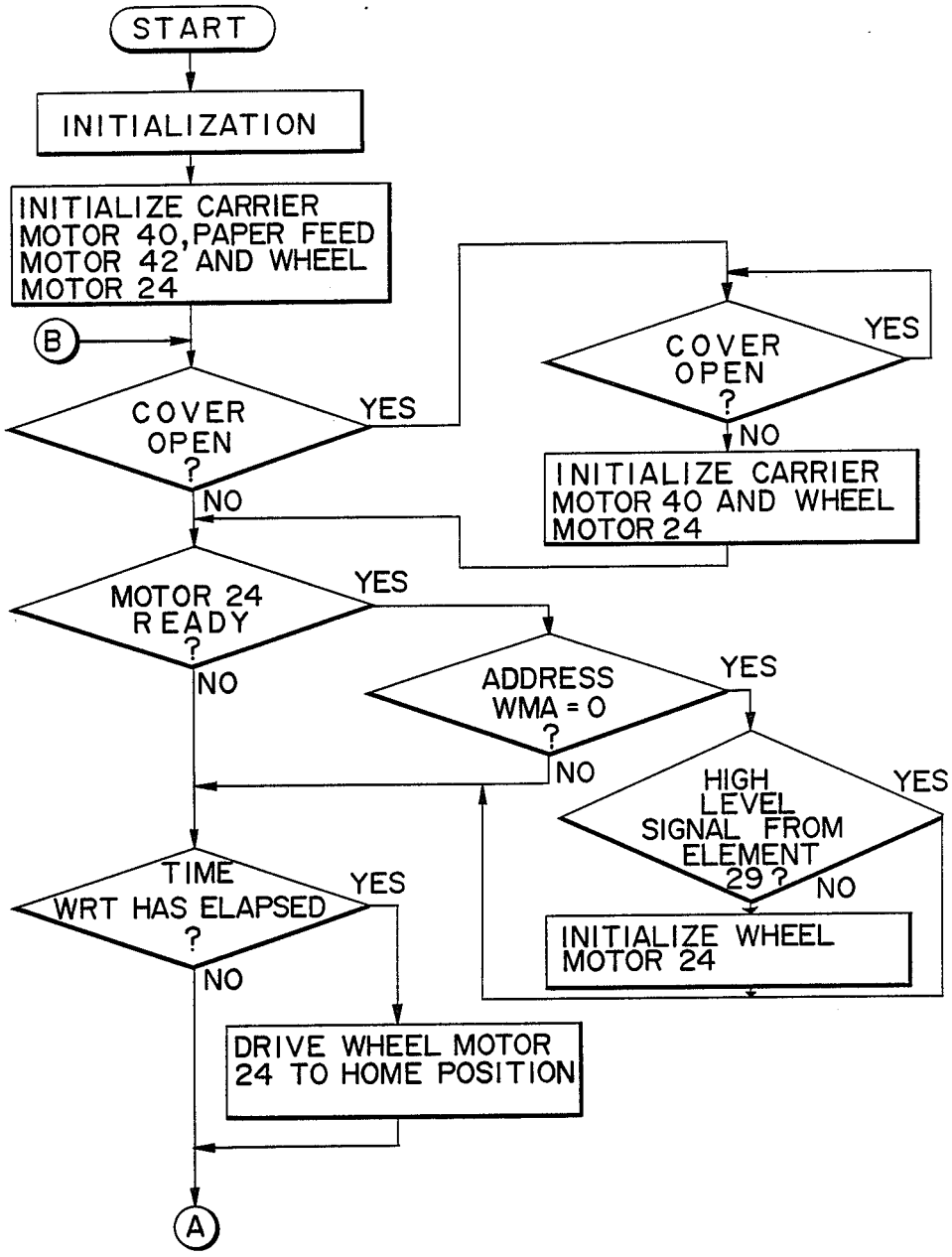
FIGS. 8A and 8B are flowcharts showing the operation of a data processing unit shown in FIG. 7.
Figure 8B:
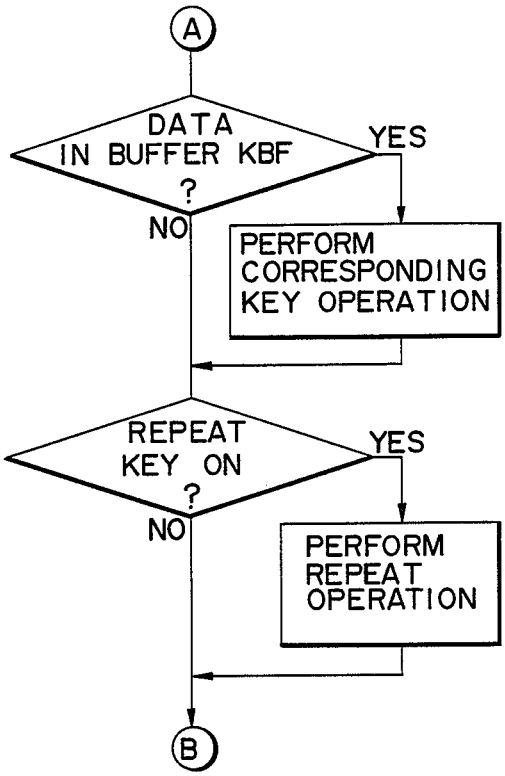

FIG. 8 shows a general flowchart for control of each section by CPU 31. When a power supply is turned on, RAM 33 is first initialized. Then, carrier motor 40, wheel motor 24, and paper feed motor 42 are initialized, in other words, these motors are set at the home position. A check is then made to see if the cover provided for the printing section is open or not. This is done by, for example, using a microswitch which is closed when the cover is closed. If the cover is open, the apparatus waits until the cover is closed. When it is detected that the cover is closed, carrier motor 40 and wheel motor 24 are initialized.

Next, a check is made to see if wheel motor 24 is ready or not. When the wheel motor is not ready, that is, when wheel motor 24 is rotating, it is useless to check the home position. Therefore, this discriminating step is executed before checking the home position. When it is detected that wheel motor 24 is ready, a check is made to see if a wheel motor address WMA is zero or not. If the wheel motor address is not zero, it is determined that spokes 19 of print wheel 17 are not returned to the home position and thereby to omit the detection step of the home position. If the wheel motor address is zero, a check is made to see if photoelectric element 29 detects the light from light emitting element 28 or not. If no light is detected, it is decided that there is a deviation between the home position set on the basis of the data and the actual home position and wheel motor 24 is initialized. After completion of the above-mentioned series of checking steps, a check is then made to see if wheel return timer PWT has timed up a wheel return time WRT or not. If YES, wheel motor 24 is driven to return to the home position. This step is executed to return print wheel 17 to the home position in the case where print wheel 17 stops at the last print position for a predetermined time. A check is then made to see if data is stored in key buffer KBF or not. If data is stored, this data is processed, namely, the key process is executed. Then, a check is made to see if the repeat key has been pressed or not. If the repeat key is pressed, the repeat operation is performed. Thereafter, a check is again made to see if the cover is open or not.

Figure 9:
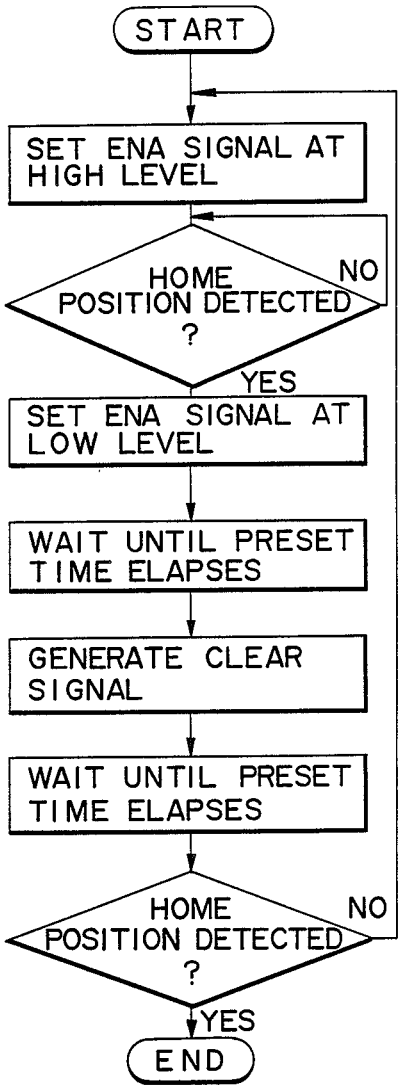
FIG. 9 is a flowchart showing a wheel initialization routine in FIG. 8A.

In this checking process, wheel motor 24 is initialized on the basis of FIG. 9. Namely, rotation instruction signal ENA is first set at a high level. The home position is detected by a detection signal from photoelectric element 29. When the home position is detected, rotation instruction signal ENA is set at a low level. Subsequently, clear signal CLR is generated after an elapse of a preset delay time which is decided by the delay time and vibration time inherent to the motor. After an expiration of a preset delay time, the home position is again detected. Until the home position is detected, this process is repeated. According to the embodiment of the invention with such a construction as mentioned above, the process to initialize wheel motor 24 is executed when the power supply is turned on, when the cover is closed after it was opened, or when the home position is not detected even after an elapse of a preset time after completion of the operation of print wheel 17. In this initialization process, rotation instruction signal ENA is first set at a high level. Flip-flop circuits 44 and 45 are made operative at a timing of clock signal CLK. The levels of respective excitation signals A, $\overline{A}$, B, and $\overline{B}$ are set to "1" or "0" in accordance with a predetermined sequence, thereby allowing wheel motor 24 to rotate. When detecting hole 21 formed in print wheel 17 is detected by light emitting element 28 and photoelectric element 29, it is determined that the home position was preliminarily detected, and rotation instruction signal ENA is set at a low level. Thereafter, when the preset delay time has elapsed, clear signal CLR is generated. Thus, flip-flop circuits 44 and 45 are reset and excitation signals A, $\overline{A}$, B, and $\overline{B}$ are set to "1", "0", "1", and "0", respectively, thereby forcedly setting wheel motor 24 to a preset exciting phase. The level of the output signal of photoelectric element 29 is again checked in this state. When the output signal is at a high level, the initialization process is finished and the positioning process of print wheel 17 to the home position is ended. On the contrary, if the output signal is at a low level when the output of photoelectric element 29 is rechecked, it is determined that print wheel 17 is deviated from the home position, so that the initialization process is again performed.

As described above, the home position is not decided merely by detecting detecting hole 21 by light emitting element 28 and photoelectric element 29, but wheel motor 24 is further set to the special exciting phase. Therefore, even if light emitting element 28 and photoelectric element 29 are separately assembled and there is a variation in detection precision of this assembly itself, the exciting phase of wheel motor 24 at the home position can be always equalized, so that the home position can be certainly positioned.

Although the embodiment has been described with respect to the case where the invention is applied to the printing apparatus of the electronic typewriter, the invention is not limited to this case. For example, the invention may be applied to a sole printing apparatus.

Moreover, although the home position detector has been constituted by light emitting element 28 and photoelectric element 29, for example, a reflecting material may be set at the home position of print wheel 17 and the photoelectric element may be arranged on the same side of light emitting element 28 with respect to print wheel 17 in a manner such that the light emitted from light emitting element 28 and reflected by this reflecting material can be received by photoelectric element. In addition, a magnet piece and a magnetic sensor which are set at the home position may be used in place of light emitting element 28 and photoelectric element 29.

What is claimed is:

1. A home position detecting apparatus comprising:

detecting means for generating a detection signal when a limited range of positions, including a home position of a print wheel, is detected;

a stepping motor coupled to the print wheel for rotating said print wheel in response to a drive signal; and a control circuit means for generating a drive signal having a specified phase to said stepping motor in response to the detection signal from said detecting means, said specified phase corresponding to the home position of the print wheel.

2. A home position detecting apparatus according to claim 1, wherein said print wheel has a detecting hole at the home position, and said detecting means includes a light emitting element and a photoelectric element arranged to face each other such that said print wheel is interposed therebetween in order to detect said detecting hole.

3. A home position detecting apparatus according to claim 2, wherein said control circuit means includes a logic circuit means for generating drive signal components A, B, A, and B whose levels are converted in accordance with a predetermined sequence in response to an input pulse, and a control means for generating a clear signal to said logic circuit means in response to the detection signal from said detecting means, said logic circuit means, in response to said clear signal, generating said drive signal components A, B, A, B which were set at predetermined levels, respectively.

4. A home position detecting apparatus according to claim 1, wherein said control circuit means includes a logic circuit means for generating drive signal components A, $\overline{A}$, B, and $\overline{B}$ whose levels are converted in accordance with a predetermined sequence in response to an input pulse, and a control means for generating a clear signal to said logic circuit means in response to the detection signal from said detecting means, said logic circuit means, in response to said clear signal, generating said drive signal components A, $\overline{A}$, B, and $\overline{B}$ which were set at predetermined levels, respectively.

5. A home position detecting apparatus according to claim 4, wherein said logic circuit means includes:

a direction signal receiving terminal, first and second flip-flop circuits each having a D-input terminal, a Q output terminal, a $\overline{Q}$ output terminal, a trigger terminal, and a reset terminal, first and second exclusive-OR circuits whose output terminals are connected to the D-input terminals of said first and second flip-flop circuits, respectively, whose first input terminals are connected to the Q output terminals of said second and first flip-flop circuits, respectively, and whose second inputs are commonly connected to said direction signal receiving terminal, a clock terminal connected to supply a clock pulse to the trigger terminals of said first and second flip-flop circuits, and a clear terminal connected to receive said clear signal from said control means and transmit the received clear signal to the reset terminals of said first and second flip-flop circuits, wherein said drive signal components A, B, A and B are generated from the Q and $\overline{Q}$ output terminals of said first flip-flop circuit and the Q and $\overline{Q}$ output terminals of said second flip-flop circuit, respectively.

* * * * *